United States Patent [19]

Reed

[11] 4,257,763

[45] Mar. 24, 1981

[54] LOW NOX BURNER

[75] Inventor: Robert D. Reed, Tulsa, Okla.

[73] Assignee: John Zink Company, Tulsa, Okla.

[21] Appl. No.: 916,766

[22] Filed: Jun. 19, 1978

[51] Int. Cl.[3] ..... F23Q 9/00

[52] U.S. Cl. ..... 431/188; 431/284; 431/174; 431/190

[58] Field of Search ..... 431/187, 188, 284, 285, 431/351, 174, 175

[56] References Cited

U.S. PATENT DOCUMENTS

| | | | |
|---|---|---|---|
| 2,368,373 | 1/1945 | Morrell | 431/187 X |
| 2,485,656 | 10/1949 | Raskin | 431/187 X |
| 2,918,117 | 12/1959 | Griffin | 431/188 X |
| 2,935,128 | 5/1960 | Ferguson | 431/187 X |
| 3,033,273 | 5/1962 | Zink, Jr. et al. | 431/285 X |
| 3,236,279 | 2/1966 | Beyer | 431/284 |
| 3,940,234 | 2/1976 | Reed et al. | 431/174 X |
| 3,985,494 | 10/1976 | Childree | 431/175 |
| 4,004,875 | 1/1977 | Zink et al. | 431/187 X |
| 4,144,016 | 3/1979 | Takahashi et al. | 431/188 X |

FOREIGN PATENT DOCUMENTS

| | | | |
|---|---|---|---|
| 377469 | 3/1960 | Switzerland | 431/351 |

*Primary Examiner*—Carroll B. Dority, Jr.
*Assistant Examiner*—Randall L. Green
*Attorney, Agent, or Firm*—Head & Johnson

[57] ABSTRACT

A low NOx burner for a furnace operating under natural draft in which primary and secondary combustion air are provided to a first burning zone, in which either or both liquid and gaseous fuel can be used. Less than stoichiometric air is supplied in the primary burning zone and tertiary combustion air is supplied in a second combustion zone downstream from the first combustion zone. The total air supply is over the stoichiometric requirement. Air control means is provided so that a fixed ratio of primary-secondary air/tertiary air is provided for all burning and fuel rate conditions, so as to maintain the less than stoichiometric air supply to the first combustion zone. In addition, water atomization is provided upstream of the first burning zone to provide a burning chemistry which favors the reduction of NOx in the first burning zone.

5 Claims, 3 Drawing Figures

LOW NOX BURNER

CROSS-REFERENCE TO RELATED PATENT

This invention is related to U.S. Pat. No. 4,004,875, dated Jan. 25, 1977, of JOHN SMITH ZINK, et al.

BACKGROUND OF THE INVENTION

1. Field of the Invention

This invention lies in the field of liquid and gaseous fuel burning. More particularly, this invention concerns fuel burning apparatus in which the design of the burner and control of the fuel and air supply is such as to maintain a minimum value of NOx in the effluent gases.

2. Description of the Prior Art

The burning of fuels, however it is accomplished in burners, as they are known in the art of fuel burning, is productive of oxides of nitrogen (NOx) in normal operations. Such oxides of nitrogen as are produced in combination with olefinic hydrocarbons which may be present in the atmosphere constitute a source of smog.

Smog, while not necessarily lethal, is recognized universally as potentially damaging to animal tissue. Consequently, severe limitations on the NOx content of stack gases vented to the atmosphere as a result of fuels burning, have been imposed by various governmental authorities and agencies. Emission of olefinic hydrocarbons is also subject to limitations, but is a matter separate from the invention of this application.

The prior art is best represented by U.S. Pat. No. 4,004,875. This patent has been the basis of a wide application of low NOx burners in the natural gas field. Scores of burners which are based on this patent are in commercial service, where they have suppressed NOx as intended. However, the optimum operation of this prior patent has been for fixed rates of burning, where a good balance can be provided between the primary and secondary air supplies to a first combustion chamber and the supply of additional tertiary air downstream of the first combustion chamber.

The weakness of the prior design is that, for one condition of furnace draft or firing rate, the operation is ideal. However, when the firing rate changes significantly, such as from 100% to 80%, as is typical of daily process heater firing, there is difficulty in maintaining NOx suppression. The reason for this is that at reduced firing rate the furnace draft remains constant or approximately so, and increased air-to-fuel ratios destory the less-than-stoichiometric burning zone prior to tertiary air delivery/entry, which results in less than optimum NOx reduction plus higher than desirable excess air.

What is required is a burner which provides means for correction for any condition of firing, such as might be required when the furnace draft remains substantially constant as changes in firing rate are made. If such corrections can be made, the result is continuation of NOx suppression and maintenance of optimum excess air for high thermal efficiency. In the prior art burner there is no control of the tertiary air, which is caused to flow by furnace draft (less than atmospheric pressure within the furnace), while the primary and secondary air also flow for the same reason. The total air flow will vary as the square root of the furnace draft. Thus, only one rate of fuel burning or firing rate, at a condition of furnace draft will provide required excess air and NOx suppression. This would seem to indicate that control of air flow would provide some benefit.

What is not immediately evident is, that the air entry control must be proportionately controlled for maintenance of a less-than-stoichiometric burning zone prior to entry of tertiary air to the less-than-stoichiometric gases, for completion of fuel burning plus preferred excess air when firing rate is caused to vary. If the conditions as outlined are maintained, there is suitable NOx suppression in any condition of draft and firing rate, and furnace excess air remains best for high thermal efficiency. This is to say that control must be proportional and simultaneous for primary, secondary and tertiary air for best and most assured operation in all firing conditions.

SUMMARY OF THE INVENTION

It is the primary object of this invention to provide a burner for use of liquid and/or gaseous fuel with low NOx in the effluent gases.

It is a further object of this invention to provide low NOx burning for a wide range of burning rate and corresponding air supply rate.

These and other objects are realized and the limitations of the prior art are overcome in this invention by providing a fuel burner system that includes means for combustion of liquid fuels through a first burner system and gaseous fuels through a second burner system in which less-than-stoichiometric air is supplied and combustion takes place in a first combustion zone, which is surrounded by tile walls. Tertiary combustion air is provided outside of the tile wall and meets the hot reducing flame issuing from the first combustion zone in a second combustion zone downstream of the first zone.

The less-than-stoichiometric air supply to the fuel in the first combustion zone produces combustible gases, such as carbon monoxide and hydrogen, which readily reduce any NOx that has been formed in the first combustion zone.

Additionally, water atomizers are provided, associated with each of the burners and upstream of the flame, to provide additional combustible gases to help in the reduction of any NOx that may be present. As the hot gases with reduced NOx pass downstream into the second combustion zone, tertiary air flows in to complete the combustion but at a reduced temperature so as to minimize additional NOx production.

BRIEF DESCRIPTION OF THE DRAWINGS

These and other objects and advantages of this invention and a better understanding of the principles and details of the invention will be evident from the following description taken in conjunction with the appended drawings, in which.

DESCRIPTION OF THE PREFERRED EMBODIMENT

The embodiment of this invention to be described is designed for alternate or simultaneous burning of liquid and/or gaseous fuels. A design could be provided which would utilize solely liquid fuels or gaseous fuels, which might simplify the contruction but, in the embodiment to be described simultaneous use of liquid and gaseous fuels is possible.

Figure 1:
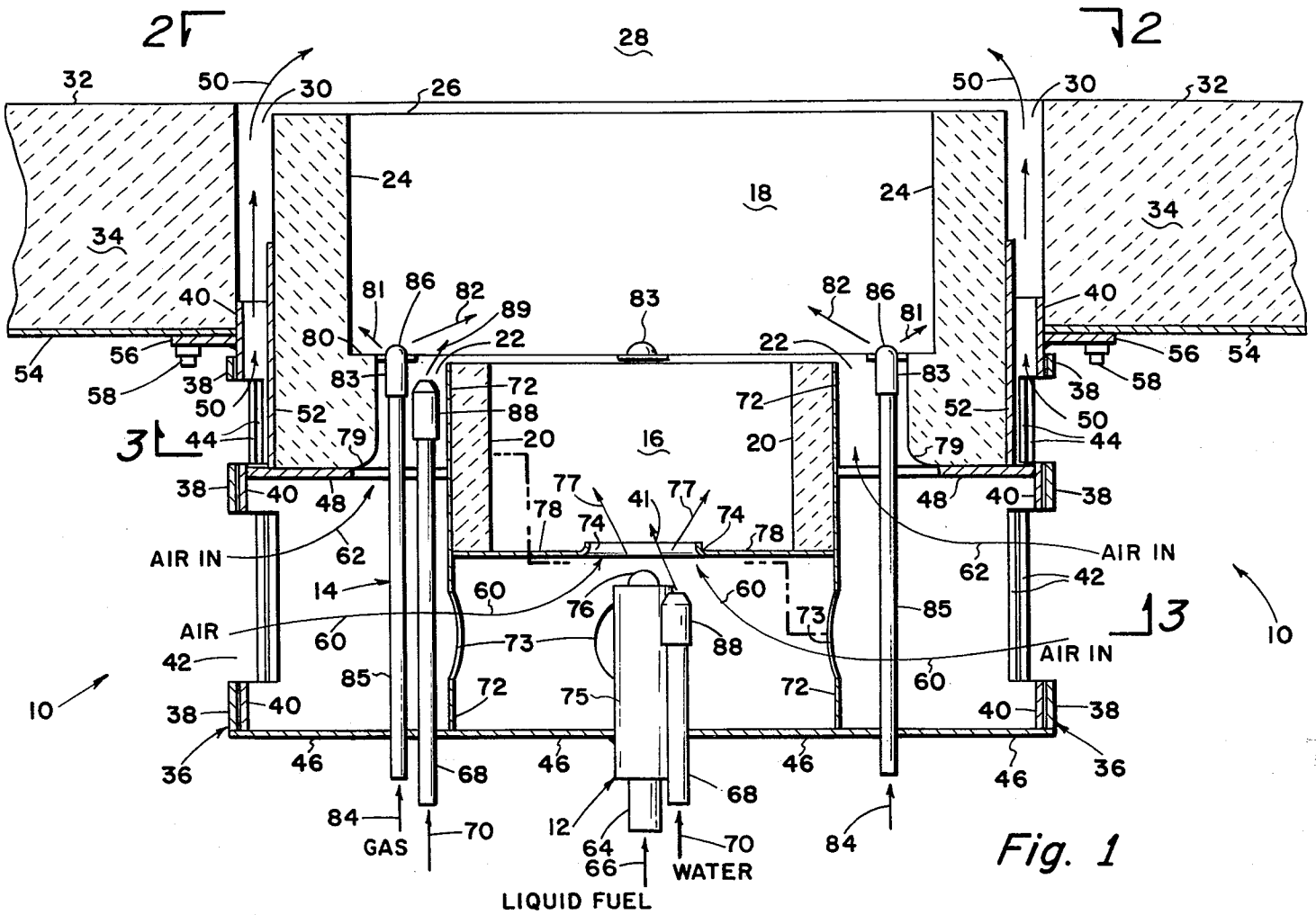
FIG. 1 represents a substantially diametral cross-section of one embodiment of this invention.

The burner of this invention in one embodiment is indicated generally by the numeral 10 in FIG. 1. A liquid fuel burner is mounted axially of the burner and is indicated generally by the numeral 12. The flame from the liquid burner burns with primary air 60 in a first combustion area 16 within a cylindrical shell of tile 20.

There is a second cylindrical tile 24 which is of larger diameter and surrounds the first tile 20 leaving an annular space 22 through which is inserted a plurality of gaseous fuel nozzles 83 to which gaseous fuel is supplied by pipes 85 in accordance with arrows 84. The outward flow of gaseous fuel is indicated by arrows 81 and 82 and flows into a second combustion zone 18 downstream of 16 and within the cylindrical tile 24. Combustion air flows in accordance with arrow 62 into the annular space 22 and past the burners 83 to mix with the fuel 81 and 82 and burn in the zone 18.

A wind box is provided by two cylindrical metal shells 40 and 38. Shell 40 is attached by welding to a circular annular ring 56, which is attached to the outer metal wall 54 of the furnace by means of bolts 58, as is well known in the art. The metal wall 54 surrounds the ceramic wall 34 of the furnace, the inner surface of which is 32.

The second shell 38 is adapted to rotate around the outside of shell 40, which is stationary and which is closed off at the upstream end by a circular plate 46.

There are two circumferential rows of identical-width rectangular openings, one row containing a plurality of openings 42 and another row containing an equal plurality of rectangular openings 44.

Figure 4:
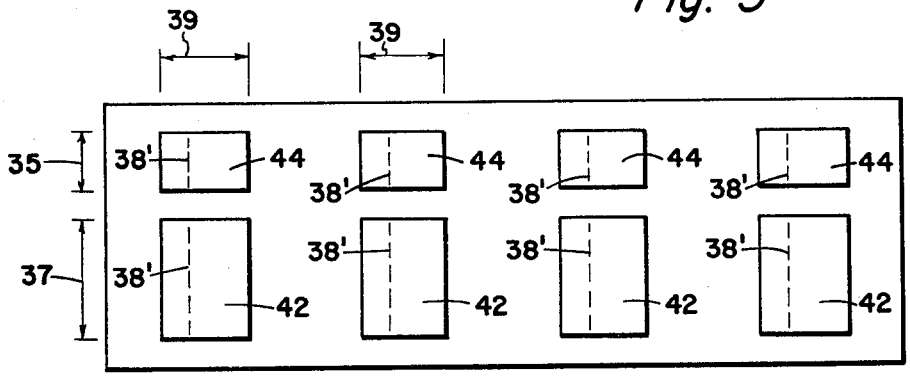

This arrangement is shown in FIG. 4, which is a picture of the sheets 40 and 38, which are laid out flat to show for each of the rectangular openings 42 and for each of the openings 44. The picture is drawn with the openings in each of the two sheets identical and fully superimposed. The width 39 of all openings is the same and the length of the first row of openings 42 and 37 and the length of the smaller openings 44 is 35. The ratio of the lengths 37 to 35 is made to be equal to the ratio of primary plus secondary air and tertiary air. For example, the primary air plus secondary air might be 70% of the total air requirement and the tertiary air would then be a minimum of 30% and possibly some larger number so as to provide a total air supply which is more than the stoichiometric value of the entire fuel burning.

As the outer sheet 38 is moved to the right, the edge 38' tends to cover part of the openings 42 and 44 in the plate 40. Thus, the total air supply is reduced but the ratio of primary and secondary to tertiary air supplied through the openings 42 and 44, respectively, is held constant no matter what the total value of combustion air supplied may be.

The primary air as arrow 60 plus the secondary air as arrow 62 flows through the openings 42. Primary air indicated by arrow 60 flows in through openings 73 in a cylindrical metal wall 72, which is used to support the tile 20. Also, a metal plate 78 is provided to support the tile 20, which has a central opening 74 through which the fuel and air are supplied to zone 16. The remainder of the air due to flow through 42 and as air 62 supports the combustion of the gaseous fuel in accordance with arrow 62 by passage through the annular space 22 and past the gaseous fuel nozzles 83, of which four are shown, as in FIGS. 2 and 3.

The second tile 24 is supported on a cylindrical shell 52, which is attached to a transverse annular plate 48 which supports the tile 24. Because of this plate 48 any air that passes up through the annular space 30 must come through the opening 44 in accordance with arrows 50 into the burning space 28 downstream of the primary combustion zones 16 and 18. The corner 79 of the tile 24 is rounded as shown in order to better provide streamlined air flow 62 into the annular space 22.

The liquid fuel burner indicated generally by 12 comprises a burner tube 64 through which liquid fuel flows in accordance with arrows 66. There are appropriate openings in a nozzle 76 at the downstream end and liquid fuel flows in accordance with arrows 77 as a fine spray of droplets atomized by the nozzle that flows along a conical wall. The burner tube 64 is supported by a larger tube 75 which is attached to the backplate 46 of the burner as by welding. Shown in close proximity to the burner tubes 64 and 75 is a water line 68 having a nozzle 88 and supplied with water under pressure in accordance with arrow 70. This nozzle 88 provides a fine atomized spray 41 which mixes with the air flow 60 and the liquid particles 77 to intimately mix with them and evaporate. The purpose of the water droplets is to provide water vapor which, in combination with the hydrocarbon fuel, provides combustible gases, such as carbon monoxide and hydrogen, which serve to reduce any NOx that may be formed in the combustion. The presence of the large proportion of nitrogen in the air supplied for combustion makes the production of NOx common in all combustion processes. In this burner system for providing a low NOx effluent, combustible gases, such as carbon monoxide and hydrogen, are provided to reduce any NOx that may be formed. This is, of course, aided by the less-than-stoichiometric supply of combustion air into the primary burning zone 16 and 18.

In the annular space 22 is placed a plurality of gaseous fuel nozzles 83, which are supplied with gaseous fuel through pipes 85 and the gas flows under pressure in accordance with arrow 84. There is a plurality of orifices 86 through which jets of gas 81 and 82 issue.

There is a narrow annular shelf 80 in the wall of the tile 24. The purpose of this shelf is to provide a quiet area with limited gas movement so that a flame formed in that region by the gas jets 81 and air from the flow through the annulus 22 will burn stably, and will serve as an ignition flame for the high velocity jets, such as 82, which might otherwise burn unstably. Again, with each of the gaseous burners 83 there is a water atomizer 88, which is fed with water under pressure through pipe 68 in accordance with arrows 70. High-speed jets of atomized droplets 89 are provided upstream of the flame so that the droplets of water mixing with the air 62 will evaporate and provide a water vapor content, which, in the heat of the flames in the zone 18, downstream of the zone 16, will provide the suitable chemistry for NOx reduction.

In review, the introduction of water vapor into the less-than-stoichiometric burning in the first combustion zone by the addition of means for entry of finely atomized water droplets for immediate evaporation due to the high heat level within the zones 16 and 18 greatly assists in NOx suppression. Zones 16 and 18 are both zones of less-than-stoichiometric air supply since the tertiary air supply is supplied through openings 44 in accordance with arrows 50 into the burning space, the combustion zone 28 downstream of the primary combustion zones 16 and 18. The additional air 50 is supplied through the annular space 30 beyond the end 26 of the second tile 24, and the combustion in the zones 16 and 18 is designed to minimize the formation or the emission of NOx from these zones into the zone 28 where excess air is supplied to burn all of the gaseous combustibles.

It is well-known by those versed in the art that NOx combines with combustibles in an oxygen-free atmosphere to eliminate NOx from the effluent gases by the well-known chemistry of combination of carbon monoxide and nitrous oxide to provide carbon dioxide and nitrogen. While both chemistries with water vapor are endothermal to lower the temperature level within the zone 16 and 18, this deters original NOx formation.

There are several important features of this invention which are illustrated in FIG. 1.

A. The burner is adapted to receive and to burn liquid fuels, gaseous fuels, or a combination of both liquid and gaseous fuel.

B. With an improved design of wind box primary plus secondary air and also tertiary air are provided separately in a fixed predetermined ratio.

C. Liquid fuel is burned in an axial burner in a first combustion zone inside of a first cylindrical tile.

D. Gaseous fuel is burned in an annular space between a first tile 20 and a second tile 24 and is provided with air in accordance with arrows 62 to burn in a combustion zone 18 downstream of the zone 16.

E. Either or both the liquid fuel and/or the gaseous fuel can be used.

F. The air supplied for combustion in the zones 16 and 18 is less-than-stoichiometric and is controlled by the wind box in B.

G. Tertiary air is provided through an annular space outside of the second tile so that the additional combustion air is supplied around the end of the second tile and supplies excess air to completely burn all of the combustible gases in the space 28 downstream from the primary combustion zone. A spray of fine water droplets is provided by water atomizers downstream of the combustion zones 16 and 18 to provide additional combustible gases for the reduction of any NOx that may be formed in the primary combustion spaces 16 and 18. Because of the oxygen-free combustion in these zones no additional formation of NOx will take place and cooling of the flame further prevents NOx formation.

Figure 2:
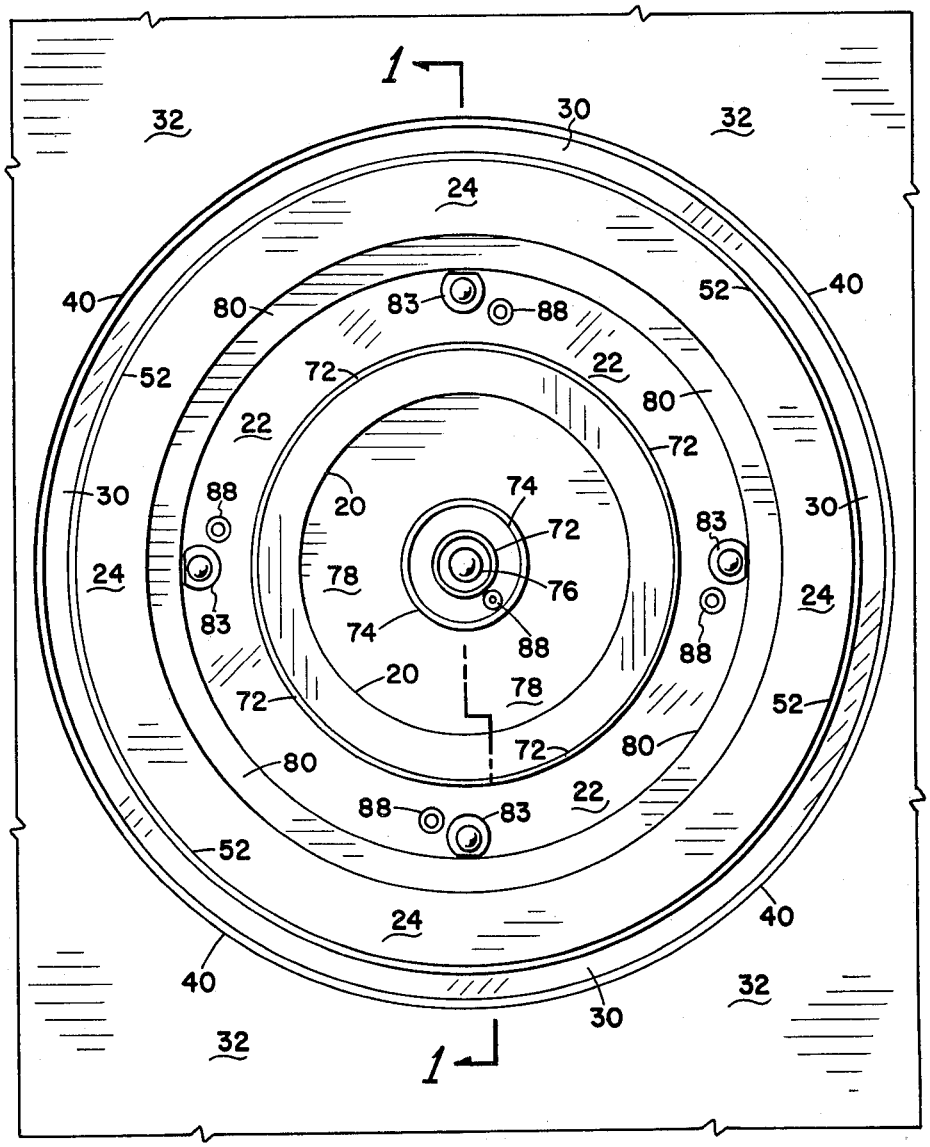
FIGS. 2 and 3 show transverse cross-sections of the embodiment of FIG. 1 across planes 2—2 and 3—3, respectively, of FIG. 1.

Referring now to FIG. 2, there is shown an end view of the burner 10 taken across the plane 2—2 of FIG. 1. All parts of FIG. 2 bear the same identification numerals as the corresponding parts in FIG. 1 so that no further description is needed.

Figure 3:
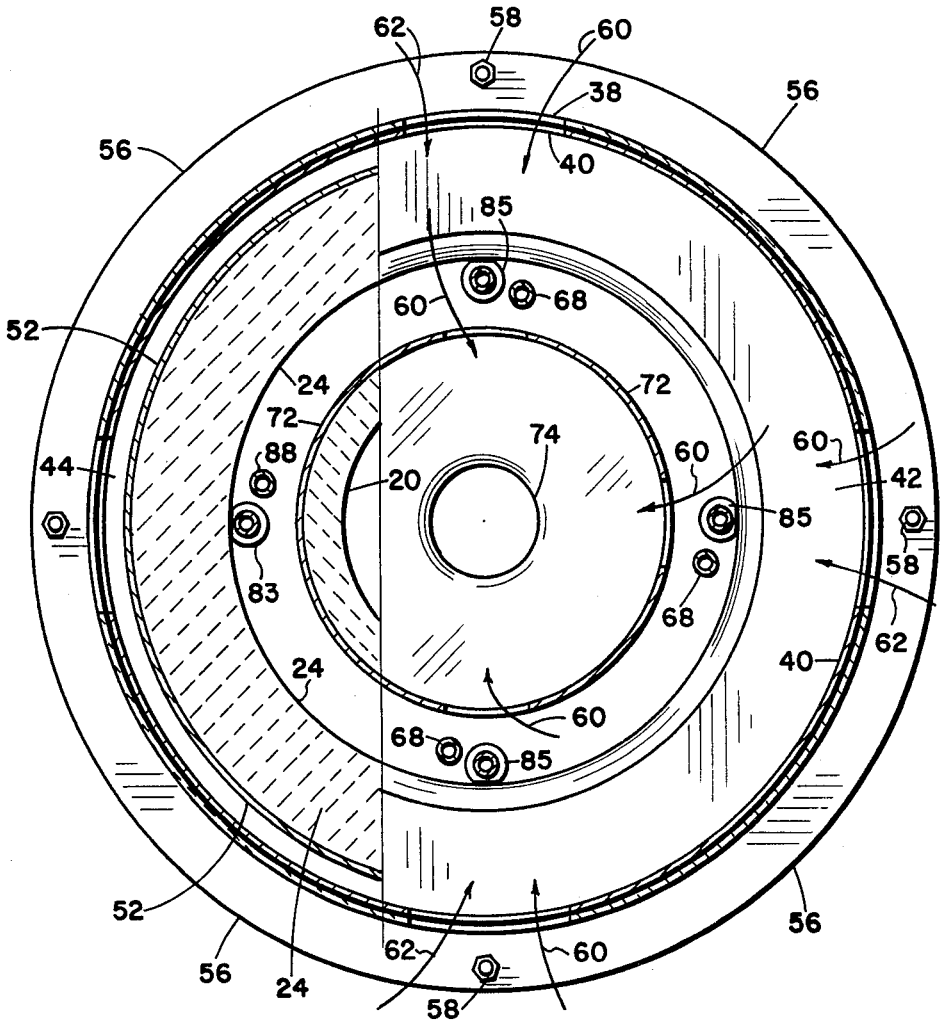

Referring now to FIG. 3, which is taken across the broken line 3—3 of FIG. 1, further detail is shown of the various parts of FIG. 1, all of which are identified by the same numerals in the several FIGURES.

A very important feature of the invention lies in the wind box, a detail of which is shown in FIG. 4. By means of this particular construction, whereby rotation of the outer wall 38, primary, secondary and tertiary airs are controlled proportionately an simultaneously, and are provided with a constant ratio of air supplies to zones 16, 18 and 28. Thus, if the air going into the zones 16 and 18 calls for 70% of the total air supply and the additional 30% to flow as tertiary air through the annular space 30 into the combustion space 28, then, no matter what is the value of total air supply obtained by shifting the plate 38 with respect to the plate 40, the ratio of air supplies to zones 16, 18 and 28 will be maintained.

Total air flow can be adjusted to any condition from 100% to 0% with completely symmetrical control of the 30% fraction and the 70% fraction, which is of critical importance in maintenance of a low NOx burning condition. The fractional adjustment must be completely coincidentally made, which is accomplished by the fixed register openings in the two walls 38 and 40, as 38 is rotated with respect to 40.

Furthermore, the provision of the atomized droplets of water is important and also is the provision of the water in the immediate vicinity of the gaseous burner and the liquid burner.

With reference to the type or design of the water-spray devices it is to be understood that for this application simple spray nozzles, which are quite common, do not provide a reasonable approach to the preferred NOx suppression, because of large water droplet production, which provides a very slow vaporization of water. Operation of this embodiment for accomplishment of a desired degree of further NOx suppression demands that the water be provided by atomization, as distinguished from spraying. This is because water droplets, as issuing from an atomizing nozzle, have substantially one-half or less the diameter of droplets from a spray nozzle. Because of this, atomized droplets will evaporate in one-sixteenth the time that is required for evaporation of sprayed droplets and further, NOx suppression requires water in vapor phase.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element or step thereof is entitled.

It is claimed:

1. A burner for minimal NOx production under varying rates of either liquid and/or gaseous fuel firing, comprising, means defining a centrally disposed primary combustion area having means to selectively supply liquid fuel and air thereto;

means defining a secondary combustion area downstream of the primary combustion area, means defining an annular space surrounding the primary combustion area and communicating with said secondary combustion area, and having means to selectively supply gaseous fuel and air thereto;

means defining a tertiary combustion area downstream of the secondary combustion area, means defining an annular space surrounding the secondary combustion area and communicating with said tertiary combustion area and means to supply air thereto; and means to simultaneously control the ratio of air to the primary and secondary combustion area relative to the tertiary combustion area.

2. The burner of claim 1 wherein the means to simultaneously control the air comprises, a wind box having a fixed inner cylindrical wall, and a rotatable contiguous outer cylindrical wall;

a first plurality of symmetrically spaced circumferential openings for the passage of air to the primary and secondary combustion areas; each of the first openings of selected angular width and length; the first openings identical in both walls;

a second plurality of symmetrically spaced circumferential openings for the passage of air to the tertiary combustion area, each of the second openings of selected angular width and length; the second openings identical in both walls.

3. The burner of claim 1 wherein the means to simultaneously control the air comprises, at least a first opening in each of two adjacent surfaces, a first surface which is relatively movable with respect to a second surface, to control flow of air to the primary and secondary combustion areas;

at least a second opening in each of two adjacent surfaces, a third surface which is relatively movable with respect to a fourth surface to control flow of air to the tertiary combustion area;

means to simultaneously move the first and third surfaces to change an uncovered area of the first and second openings;

whereby air to the primary plus secondary combustion areas and to the tertiary combustion area is maintained at the ratio.

4. The burner of claim 1 including means to selectively inject atomized water into the primary and/or secondary combustion areas.

5. The burner of claim 1 in which said ratio is in the range of 60 to 75% of the total air to the primary and secondary combustion areas.

* * * * *